United States Patent [19]

Leininger et al.

[11] Patent Number: 4,866,963

[45] Date of Patent: Sep. 19, 1989

[54] SECURITY SYSTEM FOR LOADING DOORS

[76] Inventors: David E. Leininger; Robert L. Leininger, both of 2737 Avenue M, Fort Madison, Iowa 52627

[21] Appl. No.: 158,643

[22] Filed: Feb. 22, 1988

[51] Int. Cl.[4] ..... E05B 49/00

[52] U.S. Cl. ..... 70/278; 292/144; 292/334; 292/DIG. 32; 70/282; 70/256

[58] Field of Search ..... 70/27 B, 277, 257, 256, 70/282; 292/144, 201, DIG. 32, DIG. 36, 332, 334, 335

[56] References Cited

U.S. PATENT DOCUMENTS

| | | | |
|---|---|---|---|
| 1,654,207 | 12/1927 | Bergonzoni | 70/282 |
| 2,466,855 | 4/1949 | Lauver | 292/144 |
| 2,650,388 | 9/1953 | White | 292/334 |
| 2,709,610 | 5/1955 | Chandler | 292/144 |
| 3,601,453 | 8/1971 | Silverman | 292/DIG. 32 |
| 3,614,147 | 10/1971 | Spector | 292/DIG. 32 |
| 3,830,332 | 8/1974 | Fontaine | 70/257 |
| 3,933,382 | 1/1976 | Counts | 292/144 |
| 3,950,018 | 4/1976 | Pickering | 292/144 |
| 4,021,066 | 5/1977 | McShane | 292/144 |
| 4,207,555 | 6/1980 | Trombly | 361/172 |

*Primary Examiner*—Robert L. Wolfe

*Attorney, Agent, or Firm*—Thomas E. Frantz

[57] ABSTRACT

A system for securing the loading doors of trucks, semi-trailers, and other like enclosures against forced or unauthorized entry should the usual manually operable closure device on such doors be breached. The system comprises a locking arrangement which is disposed entirely within but which is selectively operable from the exterior of the enclosure as by a special key or by activation of an electronic or electric circuit through entry of a predetermined code or signal. The locking arrangement includes a plunger which is automatically engageable with a strike member to secure a door upon its closure and which is moveable to an inoperative position by the action of a pneumatic or hydraulic cylinder or electric solenoid or other like activator.

15 Claims, 2 Drawing Sheets

FIG. 4
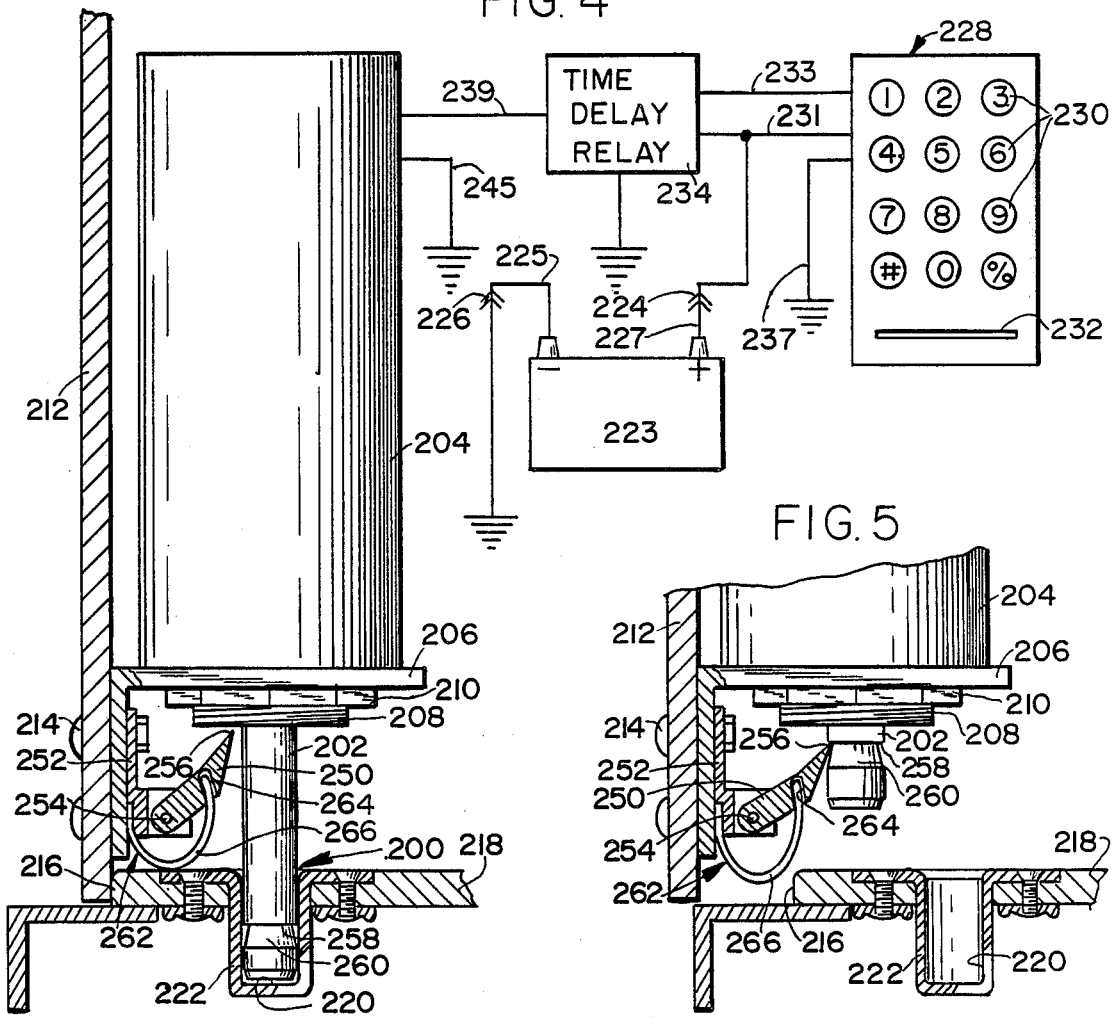
FIG. 5
FIG. 6
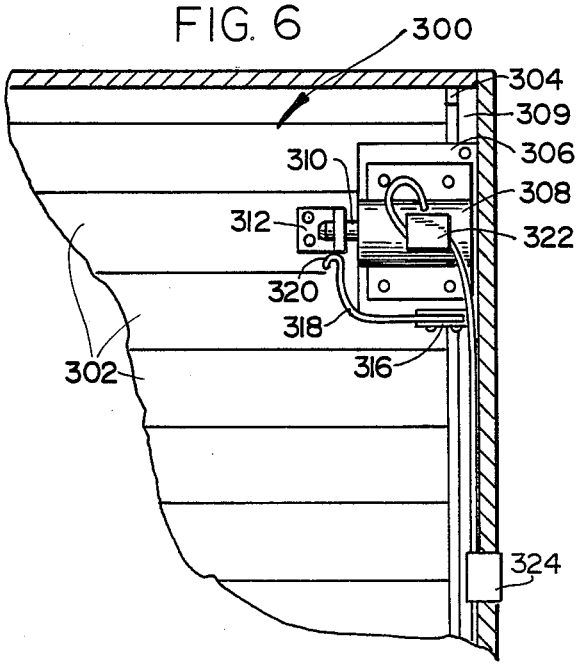
FIG. 7
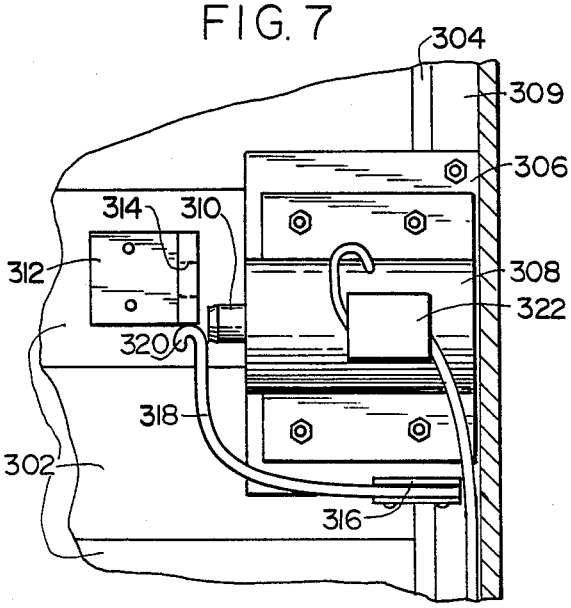

SECURITY SYSTEM FOR LOADING DOORS

The present invention relates generally to door security systems and more particularly to a system for securing the loading doors of trucks, semi-trailers, and other like mobile enclosures which frequently are left unattended for relatively long periods of time in truck terminals and freight yards, on shipping docks and "piggyback" railroad cars, and in similar commercial and industrial areas where security may be lax, at best. Under such conditions, pilfering and theft of products and goods are common as the usual vehicle door mechanism not only is located on the exterior of the truck body, and hence readily accessible, but generally can be breached fairly quickly by an experienced thief. In some cases, little more is needed than bolt cutters for severing a padlock link.

BACKGROUND OF THE INVENTION

During recent years, particularly since the railroads initiated the widespread transportation of semi-trailers on open railroad cars, thievery from trucks has increased at an alarming rate. Not only are loaded trucks, semi-trailers, and containerized units burglarized frequently when left unattended in freight yards, truck terminals and similar commercial and industrial areas, but goods and products are taken from semi-trailers even as they are being pulled through congested areas with slow moving traffic or transported on moving railroad cars.

In most cases, the process of breaking into a truck is relatively simple and requires only a minimum of time. Normally, the loading doors on trucks are at the back end of the truck body where they cannot be viewed by the driver or by someone glancing down a row of railroad cars loaded with semi-trailers. Thus, semi-trailers particularly are vulnerable as targets for thieves.

The closure mechanism for a truck loading door generally is located on the exterior of the truck body and involves a simple cam arrangement which is manually operated and which is "sealed" or locked by a padlock intended to prevent unauthorized actuation of the closure mechanism. Unfortunately, such arrangements can be easily and quickly breached or forced by someone equipped with appropriate knowledge and a bolt cutter or other means for cutting the padlock link. Breaking into a truck can be so quick and simple, in fact, that as pointed out above, it has been known to occur in the middle of slowly moving start/stop city traffic, on slowly moving trains in large railroad yards, and even between cities on country trackage.

Over the years, various suggestions have been proposed for locking devices intended to improve security of the loading doors of trucks and semi-trailers. For example, U.S. Pat. No. 3,624,761 discloses a pneumatically operated system in which a lock assembly is mounted under the floor of a truck. This system includes a locking pin mounted on a bracket extending downwardly from one of the loading doors and adapted to engage a spring mounted latch located under the truck bed as the door is closed. The doors may then be opened upon application of air pressure to an externally mounted pneumatic cylinder to disengage the latch from the locking pin. Another system is disclosed in U.S. Pat. No. 3,045,775 wherein a complex system of hydraulic values and controls is intended to secure inner doors of a vehicle if its exterior doors are breached.

Other systems for locking doors of vehicles are described in U.S. Pat. Nos. 2,198,862 and 1,154,439 wherein a latch is maintained in a locking position during such time as pneumatic or fluid pressure or vacuum is maintained in an operating cylinder.

As far as is known, however, none of the prior proposals for securing truck loading doors has met with any significant degree of commercial success. Devices such as those shown in the above mentioned patents are too complicated, expensive, cumbersome, or susceptible of malfunction or tampering to have gained wide acceptance and usage. For example, the externally mounted system in U.S. Pat. No. 3,624,761 not only involves exposure to damaging natural elements (i.e. rainwater, mud, ice accumulation, etc.), but is vulnerable to tampering by a potential thief. The systems in the other three cited patents are such that they require a source of continuous fluid or pneumatic pressure or vacuum to remain effective. Thus, they would be ineffective is separated from such a source.

Accordingly, while others in the art have recognized and attempted to develop systems for preventing the unauthorized opening of truck loading doors, such prior attempts have failed to provide a safe, effective, inexpensive and simple locking system capable of meeting the security needs of today's transportation industry.

SUMMARY OF THE INVENTION

The present invention provides a system which can be easily and inexpensively installed in truck bodies of various types, either as part of the original equipment during manufacture or as optional equipment to be added later.

Although operating in a relatively simple manner, the present system is highly effective and efficient in securing truck loading doors against unauthorized opening even should the usual outside closure mechanism be breached or otherwise rendered ineffective.

These features and advantages are provided by a security system in which all vital operating components are located within the truck body and, hence, are not only protected from the elements but are accessible only to those who are authorized to enter the truck body through possession and use of a special "key" and/or secret code. The "key" and/or code is used to selectively actuate a security device which is accessible from the exterior of the truck body and which in turn activates the internally disposed security system to permit opening of the door(s) of the truck or semi-trailer after the exterior manually operable closure mechanism is disengaged.

The present system includes lock means consisting of a latch member supported for movement between (i) a first position in which the lock means secures a truck loading door against opening even should the exterior closure mechanism be breached or otherwise disengaged and (ii) a second position in which the lock means is inoperative and the door can be opened. In the presently preferred embodiment, the latch member comprises a plunger which is both supported by and caused to move between its first and second positions by motor means consisting of a pneumatic or hydraulic cylinder or electrically operated solenoid or similar actuator.

The outer end of the plunger is sized to enter the aperture of a strike which is axially aligned with the plunger upon full closure of the door. Preferably the cylinder or solenoid is mounted on the interior surface of the door which, in the case of a semi-trailer, is the outer overlapping door. The strike is then mounted on the interior surface of the truck body proximate to the door.

A source of power is provided for operating the motor means. In the case of a pneumatic or hydraulic cylinder, the power source consists of a fluid tank such as the compressed air tank provided on the usual semi-trailer as part of its brake system. Or in the case of a solenoid or electrically driven actuator, the power source preferably would consist of the same low voltage (12 V) battery utilized by the truck or truck tractor for lights, etc.

As will be obvious to those in the art, should the present system be embodied in a semi-trailer which is disconnected from or otherwise unable to obtain power from a truck tractor, a supplemental source of power may be employed. For example, a hand carried air tank or battery may be temporarily connected to the semi-trailer long enough to operate the system. This, of course, could add to the integrity of the system as a would-be burgler would not only have to provide a source of power, but in some way obtain a key or code for operating the system from the exterior of the truck body.

A security device is operatively interposed between the power source and motor means to control the transmission of power therebetween. In a fluid operated system, the security device may consist of a valve assembly operable from the exterior of the truck by the use of a special key, which is inserted through an appropriately sized opening in the truck to actuate the valve assembly thereby operating the motor means to move the latch or plunger to its second or inoperative position. Or should the motor means be electrically operated, the security device preferably would consist of a control panel having push buttons or the like for use in entering a secret code or other specific input to actuate the guide means.

It will be understood, of course, that the present system includes power transfer means between the power source and security device and between the security device and motor means. In the case of a fluid operated system, the transfer means would consist of suitable high pressure flexible shielded hoses. And for an electrical system, the transfer means would consist of electrical wire preferably protected by suitable flexible conduit.

OBJECTS OF THE INVENTION

It is a principal object of the present invention to provide an improved security system for the loading doors of truck bodies, semi-trailers, and like enclosures.

Another object of this invention is the provision of a security system which is housed within the body of a truck or semi-trailer but which is operable from the exterior of the truck.

Yet another object of this invention is to provide a truck security system which does not require continuous availability of power to remain effective.

A still further objective of this invention is the provision of a security system which is usable not only with single and double hinged truck loading doors, but with tracked overhead sectional loading doors.

Another object of this invention is to provide a security system for truck loading doors which overcomes the drawbacks of prior security systems.

Yet a further objective of this invention is the provision of a security system which may be installed either while a truck body is under construction or as a separate option for trucks already in service.

A still further object of this invention is the provision of a security system which is low in cost, reliable in operation, rugged in service, and inexpensive to install, operate, and maintain.

The above and other objectives, features, and advantages of this invention will be apparent from the following description when read in conjunction with the accompanying drawings.

BRIEF DESCRIPTION OF THE DRAWINGS

FIG. 4 is a diagrammatic view of another embodiment of the present invention, showing an electrically operated system having means for holding the plunger in one of its positions.

FIG. 5 is a partial view of the embodiment of FIG. 4 showing the door partially open and the plunger retracted, with the plunger holding means being in operative position.

FIG. 6 is a partial elevational view of the inside back o a truck of the type having a sliding sectional overhead type door showing yet another embodiment of the present invention.

FIG. 7 is an enlarged view of a portion of the embodiment of FIG. 6, showing the door partially open with the plunger held in its inoperative position.

DESCRIPTION OF THE PREFERRED EMBODIMENT

Figure 1:
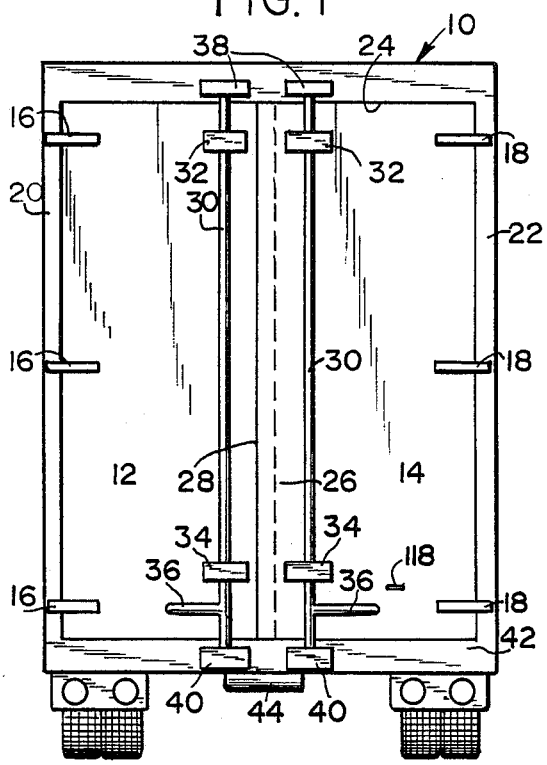
FIG. 1 is an elevational view of the back of a conventional semi-trailer of a type to which the present invention is applicable.

Continuing now with a more detailed description of the preferred embodiment of the present invention, reference is first made to FIG. 1, showing the back of a conventional semi-trailer or other similar enclosed truck body 10 having a pair of doors 12 and 14, hinged along their outer edges at 16 and 18 to opposite vertical sides 20 and 22 of door frame or opening 24. Thus, doors 12 and 14 are mounted for relative rotation in opposite directions around sides 20 and 22 between a closed position as illustrated and an open position (not shown). When either or both the doors 12 and 14 are open, ready access is provided through door opening 24 to load or unload cargo into or from the truck 10.

As will be readily apparent to those in the art, when doors 12 and 14 are closed, their outer vertical edges 26 and 28 overlap a short distance. In use, door 12 should be closed first and door 14 then closed to overlap and hold door 12 closed. Subsequently, of course, door 14 must be opened before door 12 can be moved to its open position.

Carried by each door is a generally conventional closure assembly consisting of an axially rotatable rod 30 suitably journaled in upper and lower brackets 32 and 34 on the door and provided with a handle 36. The upper and lower ends of the rod 30 engage with cam members 38 and 40 and bring the door to a fully closed position as the handle 36 and attached rod 30 are manually rotated to the position illustrated in FIG. 1. When in this position, a padlock or similar lock (not shown)

can be used to keep handle 36 and attached rod 30 in the closed position illustrated.

Suitably suspended below the floor 42 of trailer 10 adjacent its back end is a relatively small air tank 44 which, during operation of the truck 10, is compressed to about 90–120 P.S.I. to provide for proper operation of the brakes of the trailer. Suitable tires, mud flaps, lights, etc., also are provided on the semi-trailer.

As indicated previously, the manually operable closure means (rod 30, brackets 32 and 34, handles 36 and cam members 38 and 40) are located on the exterior of the semi-trailer 10 where they are readily accessible not only to authorized workers and drivers but to individuals intent upon stealing products and goods which may be contained within the semi-trailer. Previously, the security for such semi-trailers and similar truck bodies and like enclosures has been quite poor, usually consisting of a padlock or "seal" having an exposed link which can be cut without too much difficulty by someone equipped with bolt cutters or equivelant equipment. Thus, semi-trailers and trucks left unattended for any length of time, as overnight in truck terminals and railroad freight yards, on shipping docks and "piggy-back" railroad cars, or at industrial and commercial loading areas, are particularly vulnerable to thievery. Or even where a semi-trailer or truck may be in motion, as in slow stop and start city traffic or on "piggy-back" cars moving slowly through freight yards or between stops, a thief can force entry and pass products to a following accomplice or drop them along the roadway for later retrieval.

This problem of vulnerability of externally located closure means is eliminated by the present invention through employment of a security system located substantially entirely within the semi-trailer or truck body where it is not accessible to a would-be thief. A preferred embodiment of such a security system is shown diagrammatically in FIG. 2 and in detail in FIG. 3.

Figure 2:
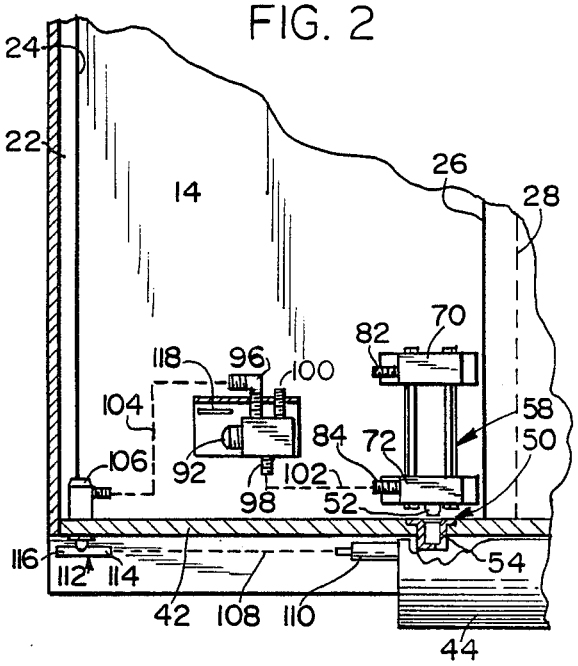
FIG. 2 is an enlarged elevational view of a portion of the inside back of the semi-trailer of FIG. 1, showing a pneumatically operated embodiment of the present invention as applied to such semi-trailer.
Figure 3:
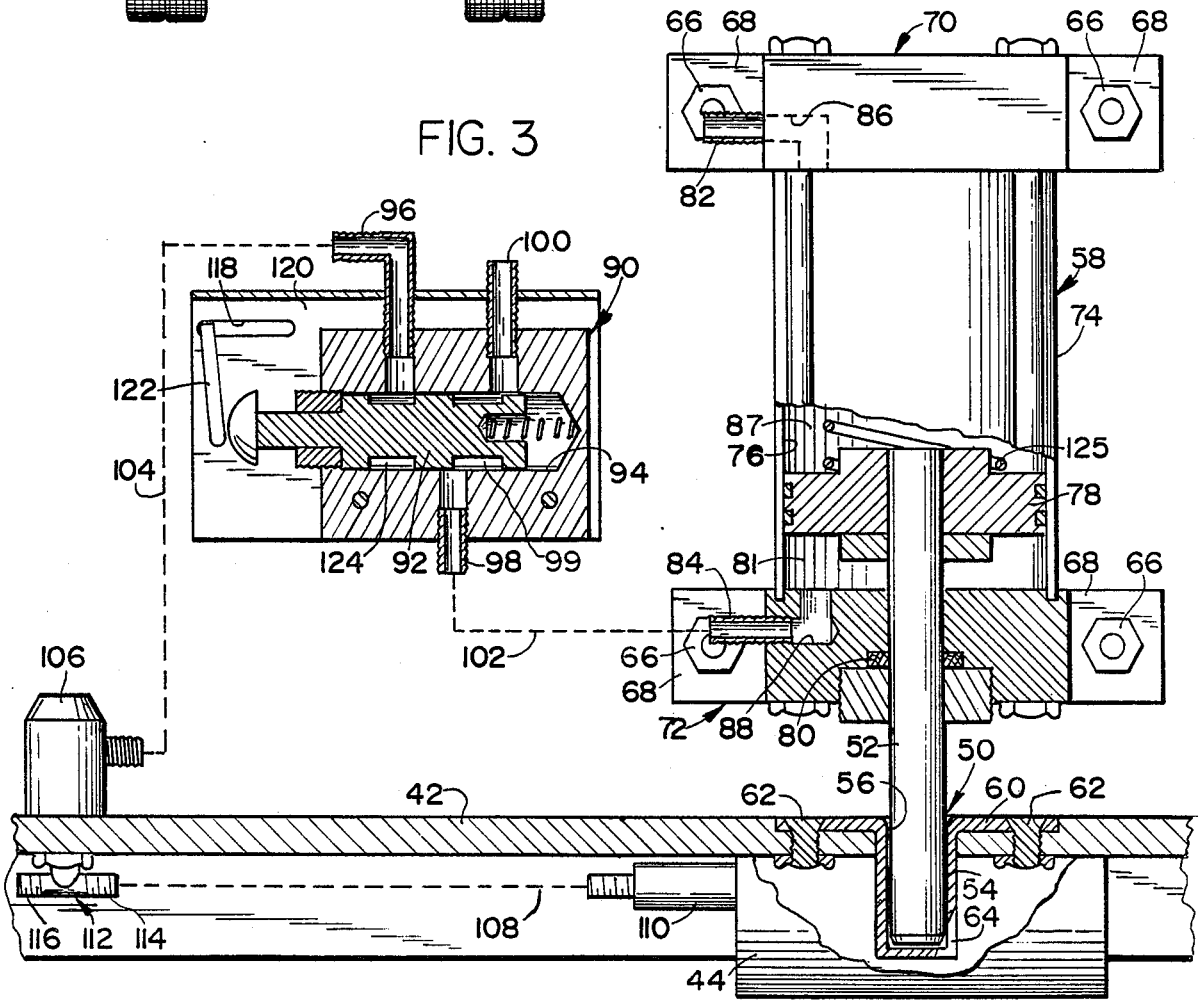
FIG. 3 is an enlarged view, partially in section, of the elements of the embodiment shown in FIG. 2.

Referring first to FIG. 3, this embodiment comprises lock means 50 consisting of a latch or plunger 52 and a cup shaped strike 54 having an aperture 56 axially aligned with and sized to receive the outer or free end of the latch 52. The latch or plunger 52 is supported for reciprocol longitudinal movement relative to the strike 54 by motor means 58 which in the instant embodiment comprises a pneumatic cylinder mounted on the interior surface of door 14 adjacent its outer edge as best indicated in FIG. 2. The strike 54 is then mounted in the floor 42 of the semi-trailer 10 proximate to the door 14 and with its aperture 56 aligned with plunger 52. Preferably, the strike 54 is recessed into the floor to avoid the creation of any protruberances in the floor likely to interfer with the use of hand trucks or other equipment in loading and unloading the semi-trailer. The flange 60 of the strike 54 is held securely by a plurality of bolts 62 extending through the floor 42. Preferably, the strike 54 is provided with a relatively small opening 64 through its lower end to permit drainage of any rain water or dirt particles which may enter the aperture 56. The opening should be sized and positioned such that the plunger 52 cannot be pushed manually out of aperture 56 by the use of a thin rod or other instrument from a position below the semi-trailer.

As is indicated best in FIG. 3, the mouth of aperture 56 of strike 54 and the lower edge of plunger 52 preferably are tapered or rounded to ensure that they are readily aligned even if the position of door 14 should vary somewhat as it is closed from time to time.

The cylinder 58 is mounted securely on the interior of door 14, preferably over or adjacent to the door frame (not shown) by a plurality of bolts 66 extending through door 14 and flanges 68 of the cylinder end portions 70 and 72. To avoid the possibility of clandestine removal or loosing of bolts 66 from the exterior of the semi-trailer, the heads thereof preferably are rounded and welded to the outer steel surface of the door 14. Further, should the door 14 be relatively thin or include relatively soft insulating materials, as in a refrigertor truck, it may be necessary or desirable to reinforce the door 14 by placement of a supplemental plate (not shown) under the ends 70 and 72 as the cylinder 58 is being mounted on door 14.

The cylinder 58 includes a cylindrical barrel 74 having a central coaxial aperture or bore 76 sized to slidingly receive the piston assembly 78. Piston assembly 78 is mounted on and longitudinally movable with plunger 52 which in turn extends downwardly through cylinder end 72 in sliding sealing engagement with packing member 80. Thus, the space between the lower surface of piston 78 and the upper surface of end portion 72 forms a closed expandable chamber 81.

The cylinder end portions 70 and 72 are provided with ports 82 and 84 which communicate at opposite ends of bore 76 through passages 86 and 88. In the present embodiment port 82 is open to the atmosphere to permit ready ingress and egress of air into and from the space 87 within the bore 76 above piston 78 as piston 78 is moved during actuation of the lock means 50. Preferably port 82 has a filter (not shown) mounted thereon to insure against the inadvertent entry of dust or dirt into the bore 76 as the cylinder of 58 is operated.

Means is provided for operating the cylinder 58 to move the plunger 52 from an extended first position engaging the strike 54 and activating the locking means 50 as shown in FIG. 3, to a retracted second position spaced from the strike 54 and deactivating the locking means 50 as illustrated in FIG. 2.

As will be understood, when the plunger 52 is in its first position engaged with strike 54 as shown in FIG. 3, door 14 cannot be opened, also securing door 12 against displacement even should the externally mounted closure means (rod 30, handles 36, etc.) be forced open or otherwise be breached from the exterior of the truck by a would-be thief. Only after the plunger 52 has been moved to its second retracted position disengaged from strike 54, can doors 12 and 14 be opened for access to the interior of the semi-trailer.

Movement of the plunger 52 and associated piston assembly 78 is accomplished pneumatically by the use of compressed air as a power medium, the control of which is effected by a security device 90. The security device 90 consists of a valve assembly including a spool 92 which is sealingly slidable in bore 94 between a first extended position as illustrated in FIG. 3 and a second retracted position as shown in FIG. 2. When the spool is in its first position, the output or outlet 98 is isolated from input or inlet 96 but in communication through circular recess 99 in spool 92 with a relief port 100 which in turn is open to the atmosphere. Preferably an air filter (not shown) is provided on relief port 100 to avoid the entry of dirt or dust into valve 90.

Outlet 98 communicates with port 84 of cylinder 58 through an air hose 102 which is indicated only diagrammatically by dashed lines. In actual practice, to protect against mechanical damage and permit convenient assembly of hose 102 to outlet 98 and port 84, the hose preferably is of a steel belted double braided type and provided on its ends with swivel reusable connectors. It will be understood, however, that a less expensive hose with crimped-on connectors could be used, particularly if the security system is installed at the factory rather than as an option later installed in the field.

Compressed air to operate the cylinder 58 is provided by a power source or air tank 44 which is connected with inlet 96 of valve 90 through air hose 104 (shown by dashed lines) and swivel assembly 106 which extends through floor 42 and which in turn communicates with tank 44 through hose 108, and pressure protection valve 110.

Power transfer means or hoses 102, 104, and 108 preferably are made of the same type of material (steel belted double braided) and provided with reusable swivel connectors. Hose 104, and of course, must be flexible and mounted within the semi-trailer in a manner which will permit unimpeded opening and closing of door 14. Such movement is fostered by use of the swivel assembly 106 which obviously should be located as close as possible to the side wall of the semi-trailer to reduce any possibility that it might interfer with or become damaged as a result of loading or unloading cargo through doorway 24.

Pressure protection valve 110 is provided in the instant system to insure that tank 44 is not inadvertently purged of compressed air should, for example, hose 108 be cut or some other type of leakage develop in the security system.

Tank 44 normally is purged of compressed air whenever the semi-trailer 10 is disconnected from a tractor. Yet after such disconnection, it may be necessary to disengage the lock means 50 and open the door 14 from time to time to permit entry in to the semi-trailer to inspect or load or unload the cargo or for some other purpose. Accordingly, it is desirable to provide for the actuation of lock means 50 by use of a supplemental power source, for example, a small hand carried compressed air tank. For this purpose the lower end of the swivel assembly 106 is provided with a T valve 112 one leg 114 of which is connected with hose 108 and the other leg 116 of which is adapted for connection with a hose from a supplemental tank (not shown) by use of a quick connect coupling, or the like. Internally, of course, the T valve 112 requires oppositely facing spring loaded one way air valves to insure that air entering either leg will be diverted only into the swivel 106 and not out of the other leg.

To operate the cylinder 58 and move the plunger 52 to its retracted second position to permit opening of door 14, a slot 118 is provided through door 14 and bracket 120 which is mounted on door 14 and which in turn holds valve assembly 90. The purpose of this slot is to permit insertion from the exterior to the semi-trailer 10 of the shank of a key like member having an offset arm 122 which can then be rotated against the outer end of spool 92 to move spool 92 to its inward second position wherein outlet 98 is isolated from relief port 100 and in communication with inlet 96 through circular recess 124 of spool 92. Such communication will permit the movement of compressed air from tank 44 or an alternate source, through T 112, swivel 106, hose 104, valve assembly 90, hose 102, port 84, passage 88, and into variable chamber 81 to move the plunger 52 and associated piston 78 rearwardly or upwardly in bore 76, thus withdrawing plunger 52 from strike aperture 56 to permit movement of doors 14 and 12 to their open positions after the exterior closure assembly has been disengaged.

After the door 14 has been opened and spool 92 is released by key member 122 to return to its extended first position, air pressure in cylinder 58 will be released through relief port 100 thereby allowing plunger 52 and piston 78 to return to their lower extended position under the influence of biasing means comprising either the weight of the parts themselves, compression spring 125 in space 87, or a combination of both. Preferably, however, plunger 52 will automatically be held in its retracted second position by a mechanism such as that illustrated and described in the embodiment of FIGS. 5 and 6 hereof, until such time as the door 14 is closed and ready to be secured once again. Otherwise, unless the extended plunger 52 is manually held in its upper position as the door 14 is being closed, it could be jammed against the back edge of the floor 42 and possibly damaged.

It will be apparent from the preceding description of the embodiment of FIGS. 1–3 that a fluid other than air could be readily employed in the system disclosed therein. For instance, with only a couple of minor and obvious changes, a hydraulic tank and pump could be substituted for air tank 44, and relief port 100 could be drained back into a reservoir connected to the tank. Accordingly, it is not believed necessary to describe in further detail a system adapted particularly for the use of liquid as the power medium.

Turning now to FIGS. 4 and 5, there is disclosed an electrically operated system in which the lock means 200 is comprised of a latch or plunger 202 supported for movement between an extended first position and a retracted second position by guide means 204. Guide means 204 consists of a generally tubular solenoid which is secured to mounting bracket 206 by thread neck 208 and lock nut 210. In turn, mounting bracket 206 is secured to door 212 by a plurality of carrage type bolts 214 which, as in the preceding embodiment, preferably are welded to the steel exterior of the door.

As best shown in FIG. 4, when the door 212 is fully closed against the back surface 216 of floor 218, the plunger 202 is axially aligned with and operatively engaged in the aperture 220 of strike member 222. So long as plunger 202 remains in strike aperture 220, it will be apparent that the door 212 is secure against unauthorized or forced opening from the exterior of the truck body.

The solenoid 204 preferably is of relatively low voltage type capable of being operated by the same automotive battery 223, which is provided in the usual truck for lighting, ignition, horns, etc. In case of a semi-trailer where the battery 223 is in the tractor, however, provision should be made on the exterior of the truck body for temporary connection of the system to a supplemental battery. Connectors 224 and 226 are provided for this purpose in the positive and negative lines to battery 223.

The security device in this embodiment may comprise a panel 228 which is accessible from the exterior of the truck body or semi-trailer and which includes an electronic circuit (not shown) programmed for actuation upon recognition of a predetermined sequence of signals from push buttons 230.

As the art is replete with push button controls of this type, it is not believed necessary for an understating of this embodiment to illustrate or describe such a circuit in detail. Preferably, however, it may be of a general type disclosed in U.S. Pat. 4,207,555, which is programmed at time of use by insertion of a magnetically encoded "key" or card into slot 232, whereafter the circuit is activated if the code entered by the push buttons matches the code secretly encoded on the card. Thus, each person authorized to enter a number of trucks protected by the present system could be provided with a personal card and code, usable with all such trucks.

As an electronic circuit of the type specified above generally is incapable of handling any significant amount of electric power, there is provided a relay 234 which is actuated by the push button panel 228 and which in turn has contacts which are adequate to carry the amount of electrical current necessary to operate solenoid 204 to move plunger 202 to its retracted second position disengaged from strike 222 as illustrated in FIG. 5. In this position, door 212 may be opened to permit entry into the interior of the truck body.

Preferably relay 234 is of a time delay type so that deactivation of solenoid 204 can be delayed and the plunger held in its retracted position until after the door has been opened. For example, in most instances, a delay of 60 or 90 seconds would provide sufficient time in which to get the door 212 open after entry of the proper code into panel 228, even if the panel should be located on the truck at a distance from the door 212.

As indicated previously, the power source used in the embodiment of FIGS. 4—5 comprises a 12 volt automotive type battery 223. The negative terminal of the battery is connected by a suitable wire 225 through disconnect 226 to the frame of the semi-trailer through the truck tractor, thus providing a ground for the system. The positive side of the battery is then connected through disconnect 224 by suitable power transfer means comprising electrically conductive wires 227, 229, and 231 to control panel 228 and suitable contacts (not shown) in time delay relay 234. The coil in relay 234 is connected to and operated by the output of control panel 228 through wire 233, and grounded through wire 235. Grounding for the electronic circuit in control panel 228 is accomplished through wire 237.

Upon operation of the coil in relay 234, the relay contacts are closed thereby allowing sufficient electrical power to flow to solenoid 204 over wire 239 from relay 234 to actuate the solenoid and move the plunger 202 to its retracted second position as shown in FIG. 5. Grounding of the solenoid 204 is accomplished through wire 245.

The time delay feature provided by relay 234 is desirable for two reasons. First, by holding the plunger 202 in its retracted position, it eliminates the liklihood that the lower end of plunger 202 will scrape across and perhaps catch on a ridge of other offset on floor 218. Secondly, as the plunger will be held in its retracted position until the door has been opened, the support mechanism illustrated in FIGS. 4 and 5 will then engage the plunger and continue to hold it up until such time as the door subsequently is closed. Thus, there is no liklihood that the person closing the door 212, perhaps several hours after opening it, will forget to hold the plunger in its retracted position as the door 212 is closed.

This support mechanism is characterized in the present embodiment by a "V" shaped lever 250, the lower end of which is pivoted on a support block 252 by pin 254. The lever 250 is movable around pin 2545 between a first position wherein its upper relatively pointed end 256 is spaced from the plunger and a second position wherein its upper end 256 is operatively engaged with a circular shoulder 258 formed on plunger 202 a short distance from its lower end by a tapered circular recess 260.

A generally "U" shaped spring 262 has one end clamped in operating position under support block 252 and the other end positioned in slot 264 of lever 250. Between the ends of the spring is a rounded bight portion 266 which when the door 212 is closed (see FIG. 4) is in sliding contact with and biased upwardly by the floor 218 to pivot the upper end 256 of lever 250 away from plunger 202, and when the door 212 is open sufficiently to disengage bight portion 266 of spring 262 from floor 218 (see FIG. 5) biases the lever 250 laterally toward the plunger 202 to permit engagement between the upper end 256 of lever 250 and shoulder 258 of plunger 202.

As the pivot pin 254 is positioned below the offset laterally from the point of engagement between lever end 256 and shoulder 258, the lever 250 will effect a wedging action to hold the plunger 202 retracted so long as door 212 is open.

Due to its rounded nature, the bight portion 266 of spring 262 will easily slide upwardly over the upper edge of the back surface 216 of floor 218 as the door 212 approaches its closed position. This will bias spring 262 upwardly, thus causing its upper end to press against the upper surface of slot 264 and rotate the end 256 of lever 250 laterally away from plunger 202 and out of engagement with shoulder 258. The plunger 202 is then free to move downwardly to its extended first position engaging aperture 220 of strike 222 as the door 212 reaches its fully closed position. Accordingly, the security system of FIGS. 4 and 5 will be activated automatically upon closure of the door 212 without danger of damage to the solenoid 204/plunger 202 and without conscience effort or attention on the part of the person closing door 212.

As indicated by the embodiment of FIGS. 6 and 7, the instant invention is applicable to sectionalized overhead doors as used both on large semi-trailers and smaller truck bodies.

In this embodiment, the door 300 is formed by a plurality of horizontally disposed panels 302 which are hinged together at their adjacent edges and which move as a unit on a track system 304. The track system extends vertically along the sides of the door opening and at its top curves rearwardly to hold the door suspended overhead when fully open.

Along one edge of the door opening is a support plate 306 bolted, welded, or otherwise attached to the truck framework 309. Preferably, this plate is positioned enough in the door opening to be above head level, and thus not likely to interfere with movement through the door.

Bolted to plate 306 is a low voltage D.C. motor means or solenoid 308 having a plunger 310 which is movable horizontally between an extended first position (see FIG.6) and a retracted second position (see FIG. 7).

Bolted and/or welded to one of the door panels 302 is a strike 312 having an aperture 314 axially aligned with and sized to receive the outer end of plunger 310 when the door 300 is full closed, as depicted in FIG. 6. In this position, the door is secured against forced entry from the exterior of the truck body.

Clamped to edge section 316 of plate 306 is one end of a flat "L" shaped spring 318 which curves around the front of the solenoid 308 and terminates in a curved outer end 320 in abutting engagement with an edge of strike 312.

Mounted preferably on the top of solenoid 308 is a time delay relay 322 which serves the same purpose as the time delay relay 234 in the embodiment of FIGS. 4 and 5.

An electronic control panel 324 is mounted on the side of the truck body in a position preferably low enough to be reached conveniently by an adult standing on the ground. As with the control panel 228 of the preceding embodiment, the panel 324 includes a plurality of push buttons or equivelant structure (not shown) which is used to activate an electronic control circuit (also not shown). Upon such activation, the necessary signal is transmitted to relay 322 which in turn activates solenoid 308 to cause movement of plunger from its extended first position (see FIG. 6) to its retracted second position (see FIG. 7) disengaged from strike 312. Door 300 may then be opened manually from outside the truck after the usual manual closure means has been disengaged.

Particularly from FIG. 7 it will be noticed that as strike 312 moves away from solenoid 308, the outer curved end 320 of spring 318 is biased for movement with strike 312 until reaching a position disposed directly in front of plunger 310. The curved end 320 of spring 318 thus abutts and holds the plunger 310 in a retracted position until such time as the door 300 is closed to again align strike aperture 314 with plunger 310 as shown in FIG. 6. As will be apparent, as door 300 approaches its closed position, the lower edge of strike 312 will engage and move the curved end 320 of spring 318 out of engagement with the end of plunger 310, thereby permitting plunger 310 to move to its extended first position and enter strike aperture 314 to automatically secure the door 300 in its closed position.

The electrical system utilized in this embodiment preferably is of the same general nature as the electrical system of the embodiment of FIGS. 4 and 5. Accordingly, further description of that system is believed to be unnecessary.

Obviously, many modifications and variations of the present invention are possible in light of the teachings of this application. It is to be understood, therefore, that the foregoing descriptions and appended drawings are illustrative only and are neither intended nor desired to limit the scope of this invention.

For example, in the embodiment of FIGS. 1–3, the cylinder 58 and strike 54 could readily be positioned at the top of the door 12 should the lower position prove undesirable for any reason. Or for extra security a cylinder and strike could by placed at both the top and bottom of the door. Or the security device of the embodiment of FIGS. 4–5 could comprise an electronic circuit controlled by a remote signal source, such as in the wireless controls now commonly used to operate television sets and other like equipment.

Having thus described certain preferred embodiments of the invention, what is claimed as new and novel and desired to be protected by Letters Patent is as follows:

1. A security system for a closed body having a door mounted thereon for movement between open and closed positions, and manually operable closure means provided externally of said body for closing said door, said security system comprising motor means mounted within said closed body on the interior of said door, a plunger axially aligned with and projecting outwardly of said motor means, said motor means supporting said plunger for relative lineal movement between extended and retracted positions upon activation of said motor means, strike means positioned within said body proximate to said door for operative engagement with said plunger upon movement of said door to its closed position and said plunger to its extended position, said engagement securing said door in its said closed position to prevent unauthorized or forced entry into said body should said closure means be breached or fail, means normally biasing said plunger toward its said extended position into operative engagement with said strike means, operating means for actuating said motor means to move said plunger from its extended to its retracted position disengaged from said strike means whereby said door is movable from its closed to its open position after release of said closure means said operating means comprising a power source, power transfer means connected between said power source and said motor means, a security device operatively interposed in said transfer means between said power source and said motor means to control the transmission of power therebetween, said security device having a body portion disposed within said closed body and provided with an input connected through said transfer means to said power source, an output connected through said transfer means to said motor means, actuating means for operatively connecting said inlet and outlet to permit the transmission of power from said power source through said transfer means and said body portion to said motor means, such transmission actuating said motor means to move said plunger from its extended to its retracted position, lock means operable from the exterior of said body for selectively generating a specific input to actuate said actuating means, and means for holding said plunger in its retracted position during such time as said door is displaced from its closed position.

2. A security system according to claim 1, wherein said strike means comprises a generally cup shaped member mounted in the floor of said body, said member defining an aperture positioned and sized to receive said projecting end of said plunger and terminating in a lower closed end having a restricted drain opening therein.

3. A security system according to claim 1, characterized by said motor means comprising a cylinder having an elongate coaxial bore, a piston longitudinally slidable within said bore, said piston being mounted on and movable with said plunger, said power source comprising a source of fluid under pressure, said power transfer means comprising a fluid line communicating with said fluid source and with one end of said bore, said body portion of said security device including a valve body wherein said input comprises an inlet connected through said fluid line to said fluid source, said output comprises an outlet connected through said fluid line to said one end of said bore, said activating means comprises a spool movable in the valve body in response to said specific selective input between a first position isolating said inlet from said outlet and a second position operatively connecting said inlet and outlet to permit movement of fluid from said fluid source to said bore to move said plunger from its extended to its retracted position.

4. A security system according to claim 3 wherein said fluid comprises air, said fluid source comprises a tank adapted to receive and retain a quantity of compressed air, said cylinder comprises a pneumatic cylinder and said fluid line comprises flexible pneumatic hose.

5. A security system according to claim 4, wherein said valve body has a relief port communicating with the atmosphere and with said bore when said spool is disposed in its said first position whereby said bore is maintained substantially at ambient atmospheric pressure while said spool is disposed in its said first position.

6. A security system according to claim 5, characterized by, said security device being secured to the interior of said door, a key having an elongate shank insertable through an aperture in said door for selective engagement with said spool to move said spool from its first to its second position and activate said security device in response to manual rotation of said key.

7. A security system according to claim 1, wherein said motor means comprises an electromagnetic solenoid, said power source comprises a source of electrical energy, and said security device includes a switch wherein said input comprises a first contact means interconnected with said power source, said output comprises a second contact means interconnected with said solenoid, and said actuating means responds to said specific selective input to electrically connect said first and second contact means to operate said solenoid and move said plunger from its extended to its retracted position.

8. A security system according to claim 7, wherein said lock means of said security system includes an electronic system for comparing an input code with a predetermined code and generating a signal for energizing said actuating means in response to a match between said input code and said predetermined code.

9. A security system for a truck or semi-trailer having a loading door movable thereon between open and closed positions and manually operable closure means provided externally of said body for closing said door, said system comprising a pneumatic cylinder mounted on the interior of said door and provided with a plunger extending coaxially from one end thereof for movement between extended and retracted positions, strike means mounted on the interior of said body proximate to said door, said strike means operatively engaging the outer end of said plunger upon movement of said plunger to its extended position, said engagement securing said door in its closed position to prevent unauthorized or forced entry into said body should said closure means be breached or fail, a resilient spring member within said cylinder normally biasing said plunger toward its extended position into operative engagement with said strike means, a tank carried by said body and adapted to contain a quantity of compressed air, a security device mounted on the interior of said body and comprising a valve having an inlet port interconnected to said air tank an outlet port interconnected to said pneumatic cylinder, a pressure relief port communicating with the atmosphere, and a spool reciprocal within said valve between a first position isolating said inlet port from said outlet port while permitting communication between said cylinder and the atmosphere through said outlet port, and a second position closing said pressure relief port and interconnecting said inlet and outlet ports to permit the injection of compressed air into said cylinder to move said plunger from its extended position to its retracted position in contravention to the biasing action of said spring, means normally biasing said spool into its first position, means operable from the exterior of said body for selectively moving said spool from its first to its second position in contravention to said biasing means to interconnect said inlet and outlet ports and inject compressed air into said cylinder to move said plunger form its extended to its retracted position disengaged from said strike aperture whereby said door is movable to its open position after release from said closure means, said operating means comprising a key having an elongate shank insertable through as aperture in said door for engagement with said spool, said key being rotatable while in engagement with said spool to effect said movement of said spool from its first to its second position.

10. A security system according to claim 9, wherein, said inlet port of said valve is interconnected to said air tank by flexible pneumatic hose, there being a pressure protection valve disposed between said hose and said air tank to protect said tank against inadvertent loss of air therefrom in the event of damage to said hose or malfunction of said system.

11. A security system according to claim 9, characterized by a door frame in one wall of the truck or semi-trailer a second door movable on the body between open and closed positions, means hinging one edge of each of said doors on opposite vertical sides of said door frame to permit relative movement of said doors in opposite directions outwardly from the center of said door frame between their closed position wherein their inner edges overlap to close said doorframe and their open position wherein they are spaced from said doorframe to permit free access therethrough, said manually operable closure means being effective to close both said doors, said pneumatic cylinder being mounted on the interior surface of the overlapping door adjacent its outer edge, said strike means being mounted in the floor of said body with an aperture in axial alignment with said plunger when said doors are disposed in said overlapping closed position whereby securement of said overlapping door in its said secure position will automatically secure said overlapped door in a secure closed position while said plunger is in its extended position in operative engagement with said strike aperture.

12. A security system according to claim 9, characterized by means for holding said plunger in its second position while said door is open, said holding means being rendered inoperative and permitting movement of said plunger to its first position upon closure of said door.

13. A security system according to claim 12 wherein said holding means comprises lever means having a free end laterally movable relative to said plunger between an operative position engaging and holding said plunger in its retracted position while said door remains open and an inoperative position disengaged from said plunger to permit movement of said plunger to its extended position upon said closure of said door, and means for moving said lever means between its said operative and inoperative positions upon movement of said door away from and into its closed position.

14. A security system according to claim 13, wherein said lever means comprises a rigid lever which is rotatable around a fixed pivot to provide said lateral movement of said free end, and said moving means comprises a cam member operatively engaging said lever and including a contact portion engagable with said closed body to move said lever to its inoperative position upon said closure of said door.

15. A security system according to claim 13 wherein said lock means includes strike means positioned for engagement with said plunger upon closure of said door and movement of said plunger to its extended position, said lever means comprises a resilient member having its free end biased for limited lateral movement with said strike between its operative position engaging said plunger and its inoperative position disengaged from said plunger.

* * * * *